US006471257B1

(12) United States Patent
Lu et al.

(10) Patent No.: US 6,471,257 B1
(45) Date of Patent: Oct. 29, 2002

(54) ELECTRIC DOOR LOCK

(76) Inventors: Chao-Jung Lu, 13F, No. 199-1, Kuang-Fu N. Rd., Sung-Shan Dist., Taipei City (TW); Yung-Chen Lin, 3F, No. 27, Jen-Yi-Hsin-Tsun, Tung Dist., Chia-yi City (TW)

( * ) Notice: Subject to any disclaimer, the term of this patent is extended or adjusted under 35 U.S.C. 154(b) by 0 days.

(21) Appl. No.: 09/977,892

(22) Filed: Oct. 15, 2001

(51) Int. Cl.[7] ..... E05C 1/06
(52) U.S. Cl. ..... 292/144; 70/280
(58) Field of Search ..... 70/275, 280, 221–223, 70/472; 292/142, 144, DIG. 27

(56) References Cited

U.S. PATENT DOCUMENTS 5,857,365 A * 1/1999 Armstrong ..... 70/279
6,012,310 A * 1/2000 Hsiao ..... 70/278.2
6,283,515 B1 * 9/2001 Redan ..... 292/144

FOREIGN PATENT DOCUMENTS

JP 11-217962 * 10/1998 ..... E05B/47/00

* cited by examiner

*Primary Examiner*—Gary Estremsky
(74) *Attorney, Agent, or Firm*—Darby & Darby

(57) ABSTRACT

In an electric door lock, a spindle with a manually operable rotary knob is connected operably to a deadbolt, and has a spindle coupling ring sleeved co-rotatably thereon, and a rotary seat sleeved rotatably thereon. The rotary seat has a clutch portion which is surrounded by a stationary seat and which is provided with angularly displaced resilient locking units that normally engage the stationary seat, and is disengaged from the stationary seat to permit operation of the rotary knob to rotate the spindle. An electric driving motor has a transmission shaft coupled to the rotary seat. The locking units are disengaged from the stationary seat and engage the spindle coupling ring when the motor is operated to rotate the rotary seat, thereby resulting in co-rotation of the spindle.

7 Claims, 8 Drawing Sheets

ELECTRIC DOOR LOCK

BACKGROUND OF THE INVENTION

1. Field of the Invention

The present invention relates to an electric door lock, more particularly to an electric door lock which is operable both manually and electrically.

2. Description of the Related Art

Electric door locks are known in the art. A conventional electric door lock generally includes an electric motor with a transmission shaft coupled to a spindle which is connected operably to a latch bolt. By operating the electric motor, the spindle is rotated to move the latch bolt between locking and unlocking positions. On the other hand, a conventional manually operable door lock is known to include a lock body having a manual operating portion and a key-operated lock unit which are operable for rotating a spindle, and a latch bolt connected operably to the spindle. By operating the manual operating portion or by operating the lock unit with the corresponding key, the spindle can be rotated to move the latch bolt between locking and unlocking positions.

In applicant's co-pending U.S. patent application Ser. No. 09/698,540, filed on Oct. 27, 2000 now abandoned, there is disclosed an electric door lock that is operable electrically and manually so as to provide added convenience for the user.

SUMMARY OF THE INVENTION

The object of the present invention is to provide an electric door lock that is operable both electrically and manually.

Accordingly, the electric door lock of the present invention includes a lock housing, a deadbolt, a manual operating member, a spindle coupling ring, a rotary seat, a stationary seat, a plurality of resilient locking units, an electric driving motor, an electric switch unit and a switch actuator. The deadbolt is mounted in the lock housing, and is movable between locking and unlocking positions. The manual operating member is mounted on the lock housing, and has a deadbolt operating spindle that extends into the lock housing and that is connected operably to the deadbolt, and a manually operable rotary knob that is secured to one end of the spindle and that is disposed externally of the lock housing. The spindle coupling ring is sleeved on the spindle so as to be co-rotatable therewith. The spindle coupling ring has an annular outer peripheral surface formed with a plurality of first locking grooves. Each of the first locking grooves is displaced from an adjacent one of the first locking grooves by a predetermined angle with respect to an axis of the spindle. The rotary seat has a circular gear plate portion that is sleeved rotatably on the spindle. The gear plate portion has a peripheral edge formed with a set of transmission teeth. The rotary seat further has an annular clutch portion connected fixedly and co-axially to the gear plate portion. The clutch portion is disposed around the spindle coupling ring, and has an inner surface confronting the spindle coupling ring, and an outer surface opposite to the inner surface. The clutch portion is formed with a plurality of mounting holes which are aligned respectively with the first locking grooves in the spindle coupling ring. Each of the mounting holes has an open inner hole end formed at the inner surface and an open outer hole end formed at the outer surface. The stationary seat is disposed within and is secured to the lock housing. The stationary seat has a ring portion which is disposed around the clutch portion and which has an annular inner peripheral surface confronting the clutch portion. The inner peripheral surface is formed with a plurality of second locking grooves. Each of the second locking grooves is displaced angularly from an adjacent one of the second locking grooves by the predetermined angle with respect to the axis of the spindle. The locking units are mounted respectively in the mounting holes in the clutch portion. Each of the locking units has a locking member that has an inner locking portion disposed at the inner hole end of the respective one of the mounting holes, and an outer locking portion disposed at the outer hole end of the respective one of the mounting holes. The locking member is normally disposed in a first position, in which the outer locking portion of the locking member projects radially and outwardly from the outer surface of the clutch portion and engages a respective one of the second locking grooves in the stationary seat for locking the rotary seat to the stationary seat, and in which the inner locking portion of the locking member is retracted into the mounting hole and disengages from a respective one of the first locking grooves in the spindle coupling ring for unlocking the rotary seat from the spindle coupling ring. The rotary knob is operable to rotate the spindle for moving the deadbolt between the locking and unlocking positions when the locking members are disposed in the first position. The electric driving motor has a transmission shaft coupled to the transmission teeth of the rotary seat. The electric driving motor is operable to drive rotation of the rotary seat for moving the locking units to a second position, in which the outer locking portion of the locking member of each of the locking units slides past the respective one of the second locking grooves and disengages from the respective one of the second locking grooves for unlocking the rotary seat from the stationary seat, and in which the locking member is depressed by the inner peripheral surface of the ring portion of the stationary seat against restoring action thereof so as to enable the inner locking portion of the locking member to project from the inner surface of the clutch portion and engage the respective one of the first locking grooves in the spindle coupling ring for locking the rotary seat to the spindle coupling ring, thereby enabling co-rotation of the spindle for moving the deadbolt between the locking and unlocking positions. The electric switch unit is mounted in the lock housing, and is connected electrically to the electric driving motor. The switch actuator is mounted on the spindle for co-rotation therewith, and projects in a radial direction with respect to the axis of the spindle. The switch actuator is movable with the spindle relative to the electric switch unit, and enables the electric switch unit to control operation of the electric driving motor in a manner that the electric driving motor drives rotation of the spindle by the predetermined angle when the electric driving motor is operated.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
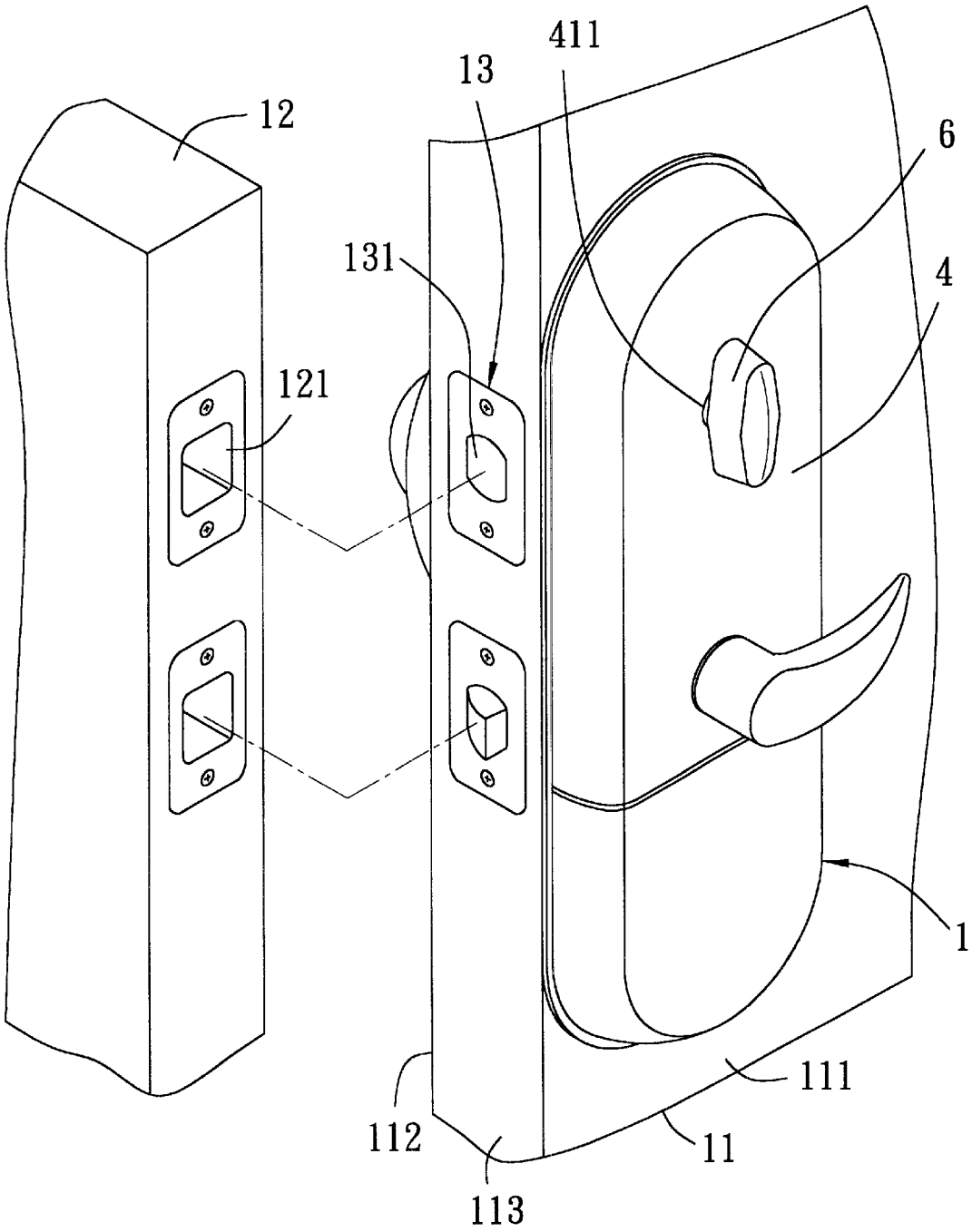
FIG. 1 is a perspective view illustrating a preferred embodiment of an electric door lock according to the present invention when installed on a door.

Referring to FIG. 1, the first preferred embodiment of the electric door lock 1 according to the present invention is adapted to be installed on a door panel 11 which is mounted pivotally on a door frame 12. The door panel 11 has an inner side wall 111, an outer side wall 112, and a peripheral edge wall 113 interconnecting the inner and outer side walls 111, 112.

Figure 2:
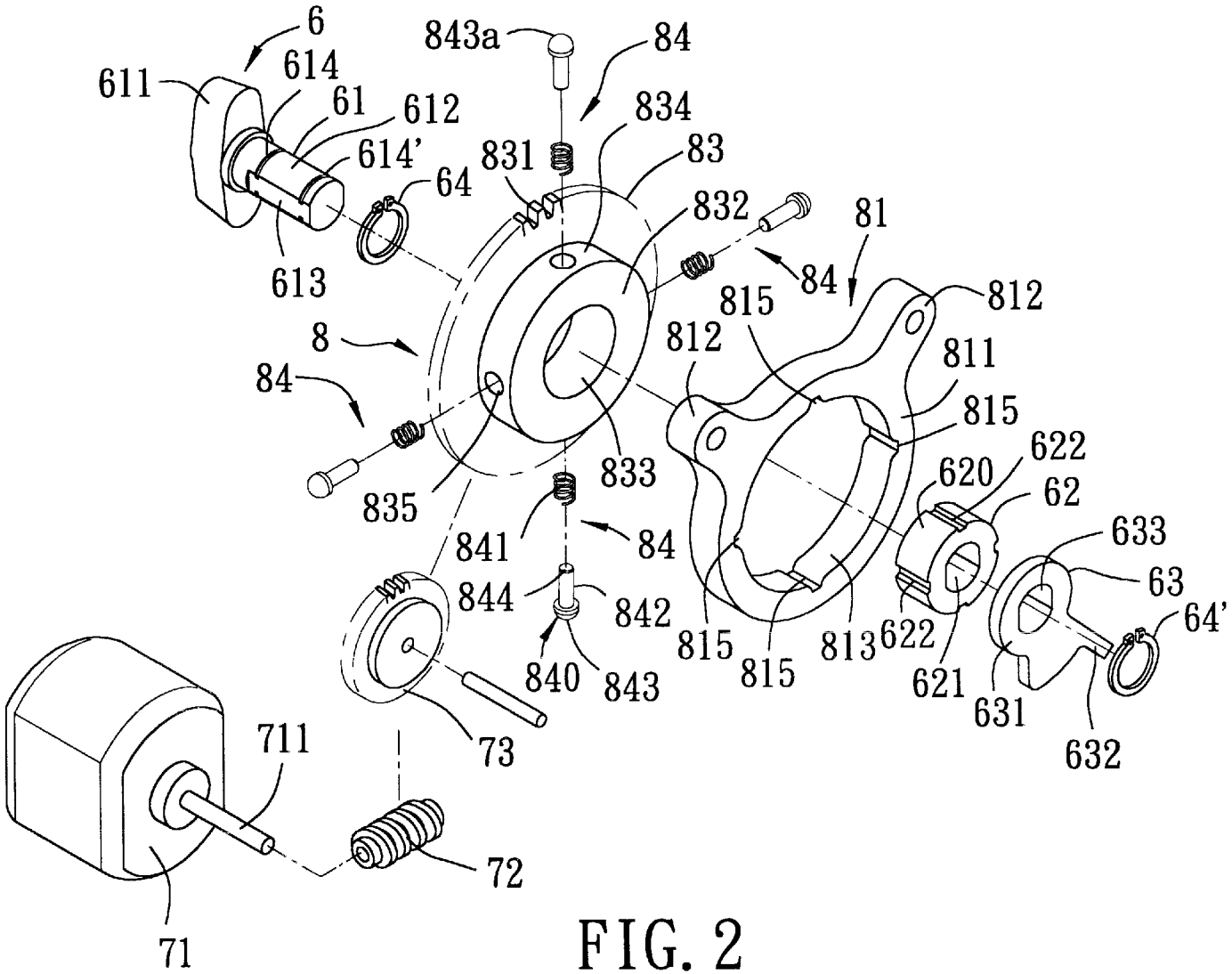
FIG. 2 is an exploded perspective view of the preferred embodiment, where a lock housing and a deadbolt are removed for the sake of clarity.
Figure 3:
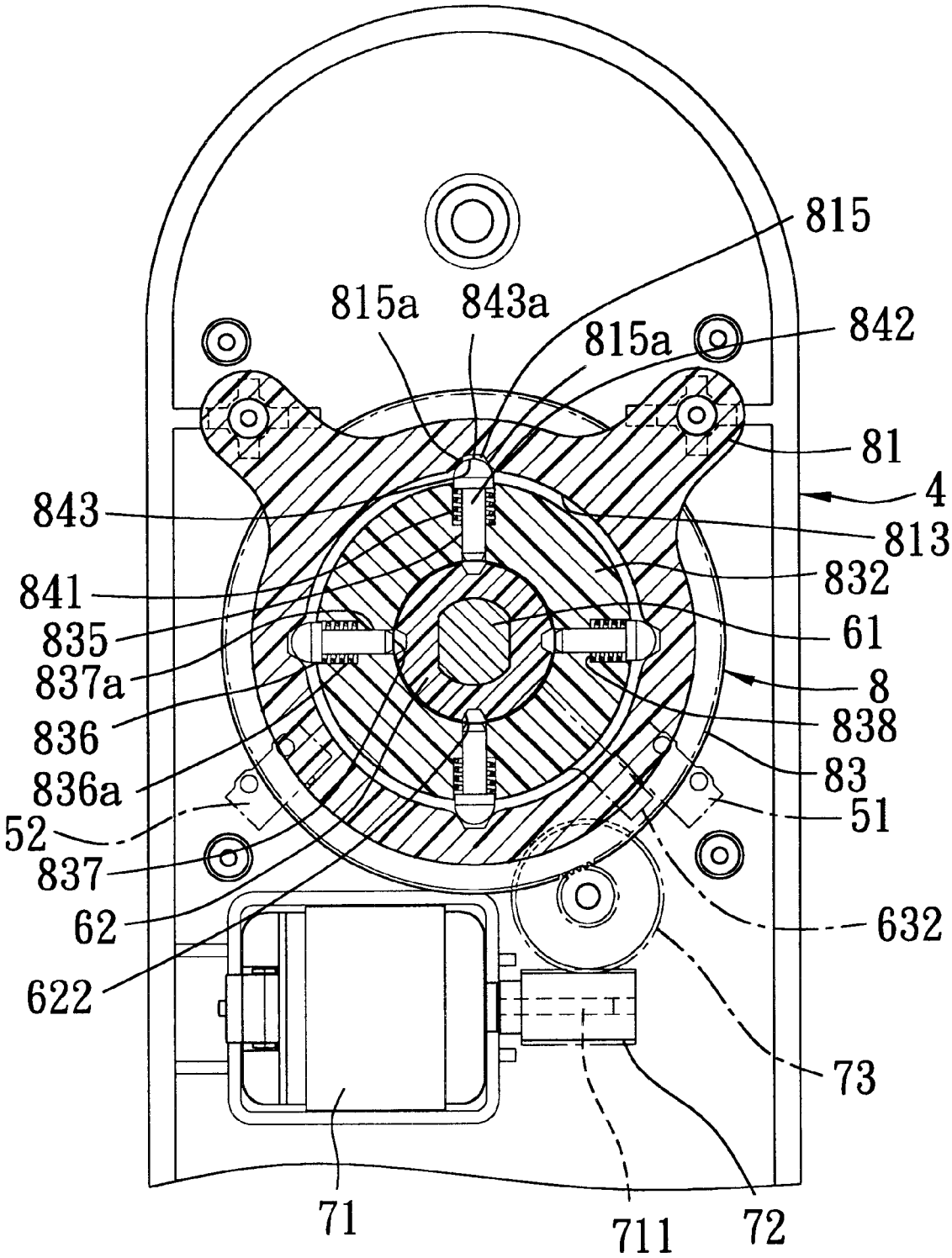
FIG. 3 is an elevational sectional view of the preferred embodiment when locking units thereof are disposed in a first position.

Referring to FIGS. 1 to 3, the electric door lock 1 of the preferred embodiment is shown to include a lock housing 4, a deadbolt 131, a manual operating member 6, a spindle coupling ring 62, a rotary seat 8, a stationary seat 81, a plurality of resilient locking units 84, an electric driving motor 71, an electric switch unit including a locking switch member 52 and an unlocking switch member 51, and a switch actuator 63.

The lock housing 4 is adapted to be mounted on the door panel 11, and has the deadbolt 131 mounted therein. The deadbolt 131 is operable to move between a locking position, in which the deadbolt 131 projects from the peripheral edge wall 113 of the door panel 11 and is adapted to extend into a deadbolt hole 121 formed in the door frame 12, and an unlocking position, in which the deadbolt 131 is retracted into the peripheral edge wall 113 of the door panel 11. The manual operating member 6 is mounted on the lock housing 4, and is disposed adjacent to the inner side wall 111 of the door panel 11. The manual operating member 6 has a deadbolt operating spindle 61 which extends through a spindle hole 411 formed in the lock housing 4 and into an interior of the lock housing 4, and which is connected operably to the deadbolt 131 in a known manner for moving the deadbolt 131 between the locking and unlocking positions. The spindle 61 has two diametrically opposite flat surfaces 613, and two diametrically opposite curved surfaces 612 interconnecting the flat surfaces 613 so as to provide the spindle 61 with a symmetrical and non-circular cross-section. The curved surfaces 612 are formed with first and second retaining grooves 614, 614' which are displaced from each other in the longitudinal direction of the spindle 61 for engaging first and second retaining rings 64, 64', respectively. The manual operating member 6 further includes a manually operable rotary knob 611 secured to one end of the spindle 61 and disposed externally of the lock housing 4.

The spindle coupling ring 62 defines a non-circular spindle coupling hole 621 conforming with the cross-section of the spindle 61, and is sleeved on the spindle 61 for co-rotation therewith. The spindle coupling ring 62 has an annular outer peripheral surface 620 formed with four angularly displaced first locking grooves 622, each of which extends axially between front and rear end faces of the spindle coupling ring 62. Each of the first locking grooves 622 is displaced angularly from an adjacent one of the first locking grooves 622 by a predetermined angle, such as 90 degrees in the present embodiment, with respect to an axis of the spindle 61.

The switch actuator 63 has a ring portion 631 that similarly defines a spindle coupling hole 633 conforming with the cross-section of the spindle 61, and that is sleeved on the spindle 61 adjacent to the spindle coupling ring 62 for co-rotation with the spindle 61. The switch actuator 63 is formed with an actuating projection 632 which projects from the ring portion 631 in a radial outward direction with respect to the axis of the spindle 61.

Figure 4:
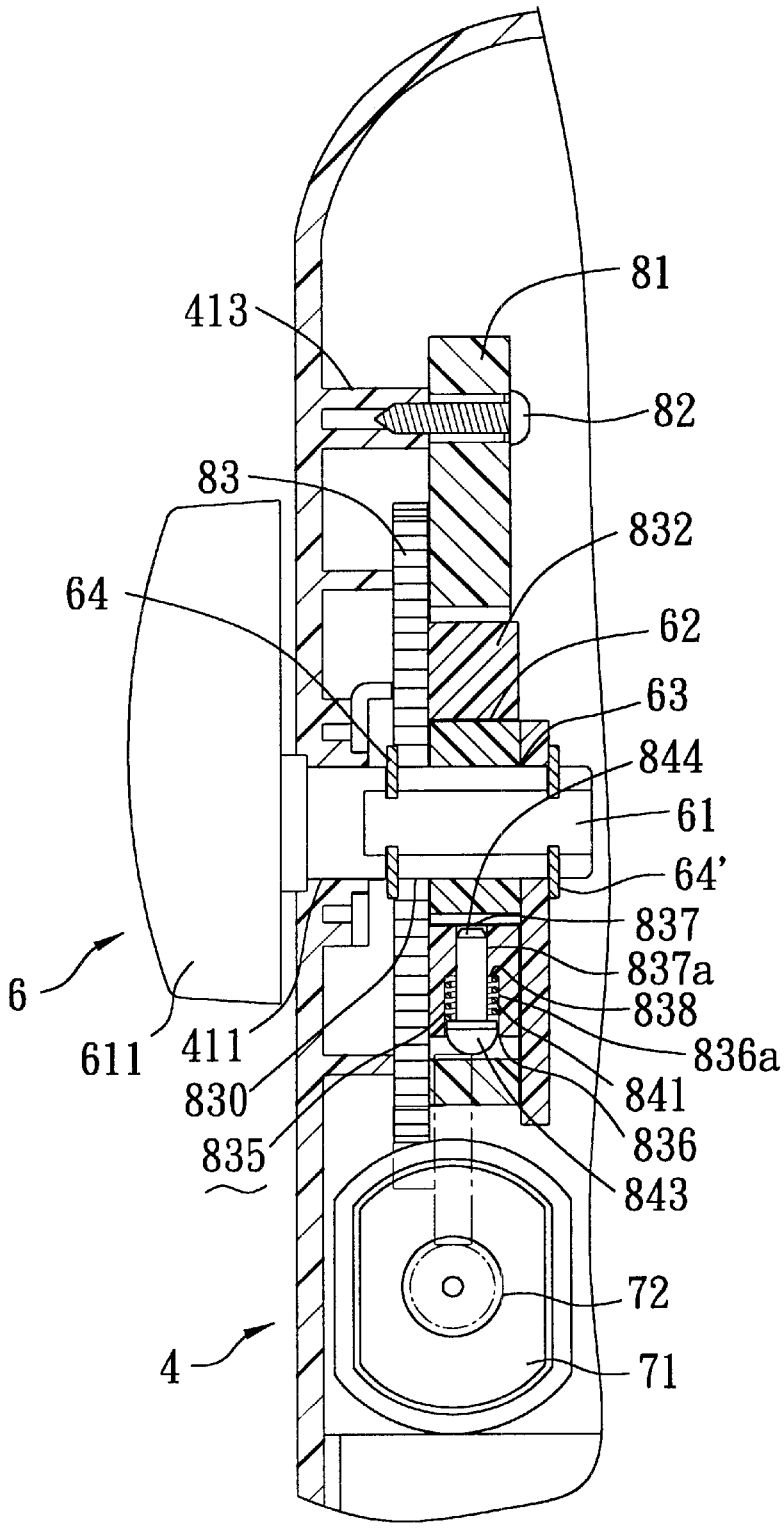
FIG. 4 is a sectional side view of the preferred embodiment when the locking units are disposed in the first position.

With further reference to FIG. 4, the rotary seat 8 is sleeved rotatably on the spindle 61, and has a circular gear plate portion 83 formed with a spindle hole 830 for extension of the spindle 61 therethrough, and an annular clutch portion 832 connected fixedly and co-axially to the gear plate portion 83. The gear plate portion 83 has an annular part projecting relative to the clutch portion 832 in radial directions, and a peripheral edge formed with a set of transmission teeth 831. The clutch portion 832 is disposed around the spindle coupling ring 62, and has an annular inner surface 833 confronting the spindle coupling ring 62 and an annular outer surface 834 opposite to the inner surface 833. The clutch portion 832 is formed with four mounting holes 835, each of which extends in a radial direction through the clutch portion 832, and each of which has an open inner hole end 837 formed in the inner surface 833 of the clutch portion 832, and an open outer hole end 836 formed in the outer surface 834 of the clutch portion 832. Each of the mounting holes 835 has a stepped hole defining wall that defines a wider hole section **836*a* adjacent to the outer hole end 836, a narrower hole section 837*a* adjacent to the inner hole end 837, and an annular shoulder 838 formed between the wider and narrower hole sections 836*a*, 837*a*. Each of the mounting holes 835 is displaced from an adjacent one of the mounting holes 835 by the predetermined angle, i.e., 90 degrees in the present embodiment. The mounting holes 835 are aligned respectively with the first locking grooves 622 in the spindle coupling ring 62**.

The stationary seat 81 is disposed within the lock housing 4, and includes a ring portion 811 and two mounting projections 812 projecting from the ring portion 811. The stationary seat 81 is secured to the locking housing 4 by means of a pair of screw rods 82 that extend through the mounting projections 812, and that are fastened to a pair of mounting posts 413 formed in the lock housing 4, as best shown in FIG. 4. The ring portion 811 is disposed around the clutch portion 832, and has an annular inner peripheral surface 813 confronting the outer surface 834 of the clutch portion 832. The inner peripheral surface 813 is formed with four second locking grooves 815, each of which extends axially between front and rear end faces of the stationary seat 81. Each of the second locking grooves 815 is displaced angularly from an adjacent one of the second locking grooves 815 by the predetermined angle, i.e., 90 degrees in the present embodiment, with respect to the axis of the spindle 61. Each of the second locking grooves 815 is defined by a groove-defining wall that has two tapered wall parts **815*a*** opposing each other.

Each of the locking units 84 is mounted in a respective one of the mounting holes 835 in the clutch portion 832, and includes a locking member 840 and a compression spring 841. The locking member 840 is in the form of a pin with a head portion 843 and a shank portion 842 that extends from the head portion 843 and that has a distal end 844 opposite to the head portion 843. The head portion 843 is disposed at the outer hole end 836 of the respective one of the mounting holes 835, has a convex outer surface 843*a,* and serves as an outer locking portion. The distal end 844 of the shank portion 842 is disposed at the inner hole end 837, and serves as an inner locking portion. The compression spring 841 is disposed between the shoulder 838 and the head portion 843 of the locking member 840 for biasing the locking member 840 in a radial outward direction along the respective one of the mounting holes 835. The locking member 840 has a length slightly longer than the depth of each of the mounting holes 315 measured between the inner hole end 837 and the outer hole end 836.

The locking and unlocking switch members 52, 51, each of which is in the form of an optoelectric switch in the present embodiment, are mounted on the lock housing 4 adjacent to the spindle coupling ring 62. In the present embodiment, the locking and unlocking switch members 52, 51 are spaced apart by an angle of about 90 degrees with respect to the axis of the spindle 61.

The electric driving motor 71 is mounted in the lock housing 4, and is connected electrically to the locking and unlocking switch members 52, 51. The electric driving motor 71 has a transmission shaft 711. A worm gear 72 is secured to the transmission shaft 711 such that the worm gear 72 is rotatable about an axis of the transmission shaft 711 during operation of the electric driving motor 71. A transmission gear 73 is mounted rotatably in the lock housing 4, and is disposed between the worm gear 72 and the rotary seat 81. The transmission gear 73 engages the worm gear 72 and the transmission teeth 831 on the gear plate portion 83, thereby transmitting rotation of the worm gear 72 to the gear plate portion 83.

Due to the biasing action of the compression springs 841, the locking members 840 are normally disposed in a first position, in which the outer locking portions, i.e., the head portions 843, of the locking members 840 project radially and outwardly from the outer surface 834 of the clutch portion 832, and engage respectively the second locking grooves 815 in the stationary seat 81 for locking the rotary seat 8 to the stationary seat 81, and in which the inner locking portions, i.e., the distal ends 844 of the shank portions 842, of the locking members 840 are retracted respectively into the mounting holes 835 and disengage from the first locking grooves 622 in the spindle coupling ring 62 for unlocking the rotary seat 8 from the spindle coupling ring 62.

When the electric door lock 1 of the present embodiment is in an unlocking state, the switch actuator 63 is disposed proximate to the unlocking switch member 51, as shown in FIG. 3. When it is desired to operate the electric door lock 1 manually, the rotary knob 611 is rotated manually to rotate the spindle 61. Since the locking members 840 are normally disposed in the first position where they are disengaged from the spindle coupling ring 62, rotation of the spindle 61 is not hindered by the rotary seat 8, thereby facilitating operation of the manual operating member 6. At this time, the locking and unlocking switch members 52, 51 are not actuated since the electric driving motor 71 is not operated.

Figure 5:
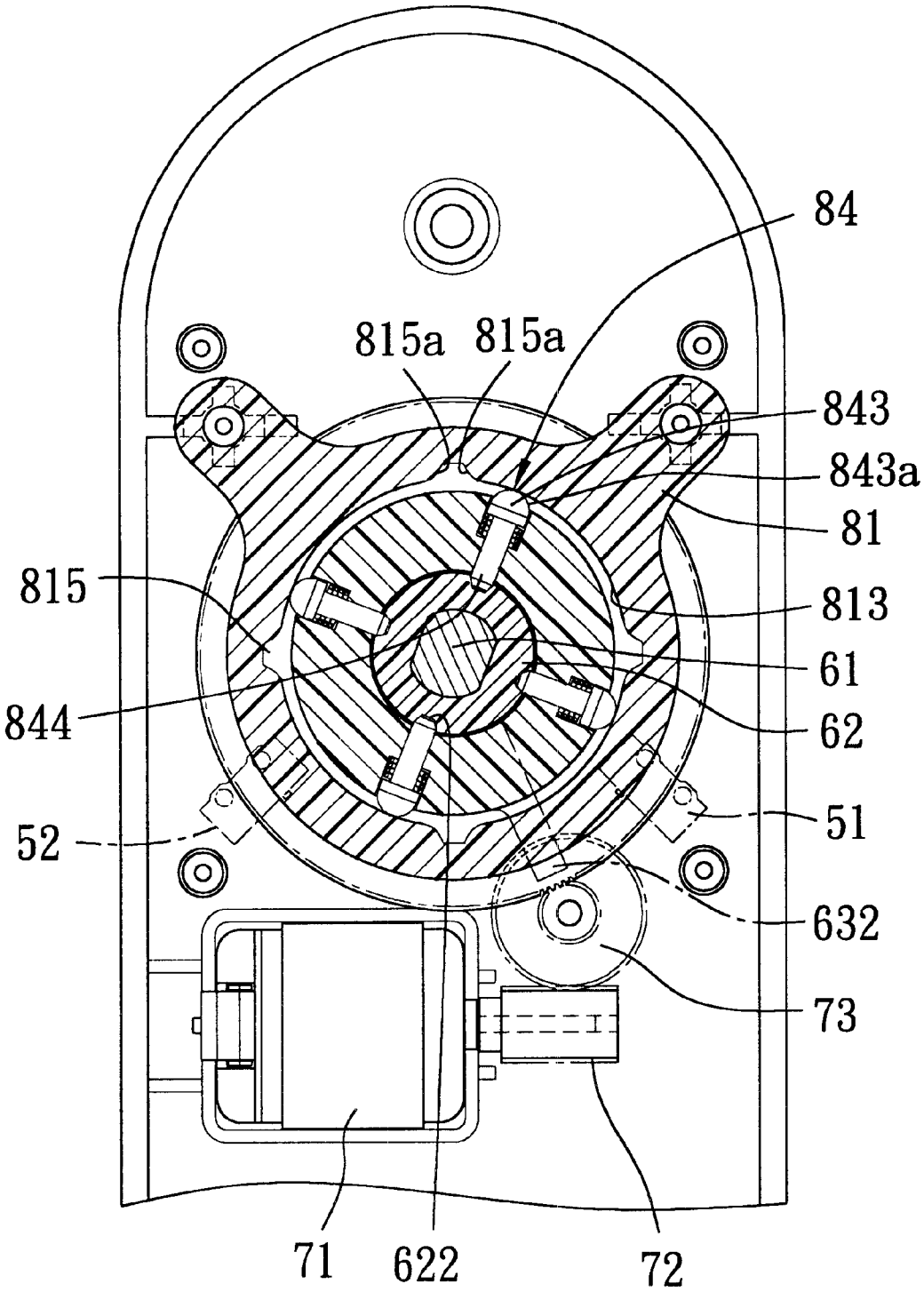
FIG. 5 is an elevational sectional view of the preferred embodiment when the locking units are disposed in the second position.

Referring to FIGS. 2, 3 and 5, to operate the electric door lock 1 of the present embodiment electrically for locking the same, the electric driving motor 71 is operated, such as by a remote controller (not shown), to enable rotation of the worm gear 72 and the transmission gear 73, which, in turn, rotates the gear plate portion 83 of the rotary seat 8 and the clutch portion 832 on the rotary seat 8. Referring to FIG. 3, when the clutch portion 832 is rotated, the convex outer surface 843*a* of the head portion 843 of each of the locking members 840 slides past one of the tapered wall parts 815*a* and disengages from the respective one of the second locking grooves 815 for unlocking the clutch portion 832 from the stationary seat 81. The locking members 840 are then depressed by the inner peripheral surface 813 of the stationary seat 81 against biasing action of the compression springs 841 to enable the distal end 844 of each of the locking members 840 to project from the inner surface 833 of the clutch portion 832 and engage a corresponding one of the first locking grooves 622 in the spindle coupling ring 62 for locking the rotary seat 8 to the spindle coupling ring 62, thereby enabling co-rotation of the spindle 61 for moving the deadbolt 131 (see FIG. 1) to the locking position, and thereby causing corresponding movement of the switch actuator 63 with the spindle 61. When the spindle 61 is rotated by the predetermined angle, such as 90 degrees in the present embodiment, the actuating projection 632 of the switch actuator 63 is moved adjacent to the locking switch member 52. Upon sensing the actuating projection 632, the locking switch member 52 is actuated to provide an electric signal to the electric driving motor 71 for deactivating the same, thereby positioning the deadbolt 131 in the locking position. Likewise, to move the deadbolt 131 from the locking position to the unlocking position, the electric driving motor 71 is operated to rotate the transmission shaft 711 and the worm gear 72 in an opposite direction. The unlocking switch member 51 operates in a manner similar to that of the locking switch member 52 for deactivating the electric driving motor 71.

Figure 6:
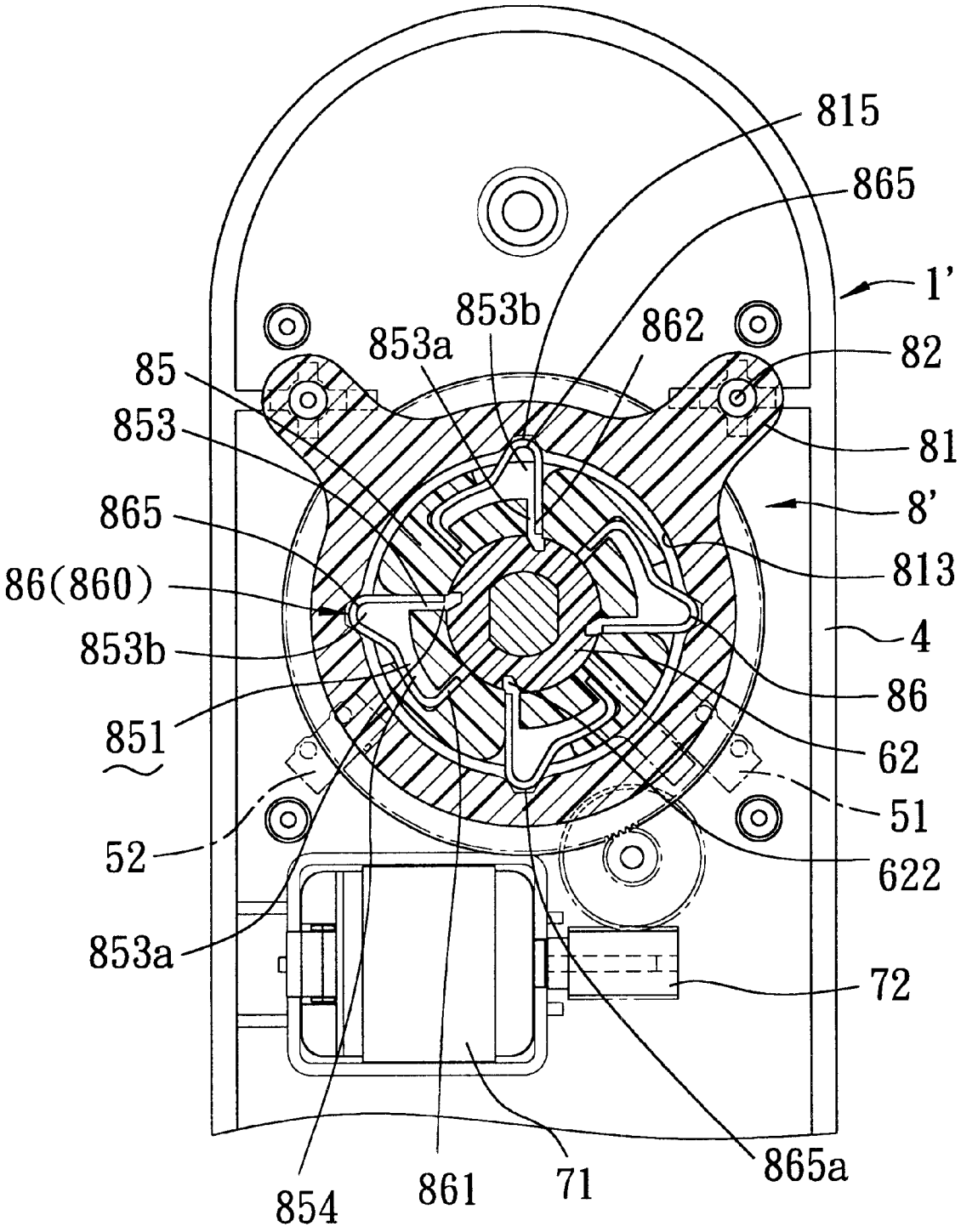
FIG. 6 is an elevational sectional view of a second preferred embodiment of the electric door lock of the present invention when locking units thereof are disposed in a first position.
Figure 7:
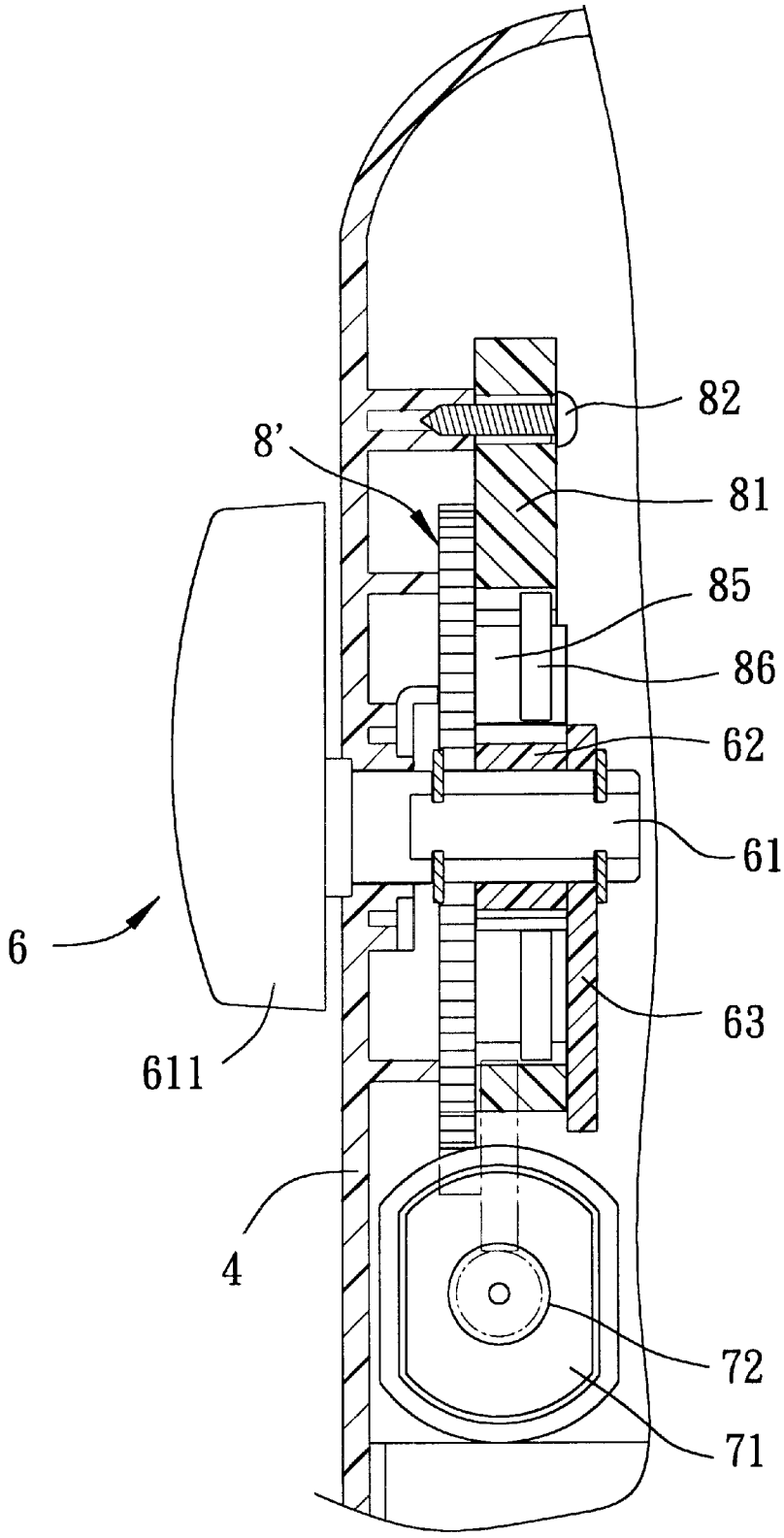
FIG. 7 is a sectional side view of the second preferred embodiment when the locking units are disposed in the first position.
Figure 8:
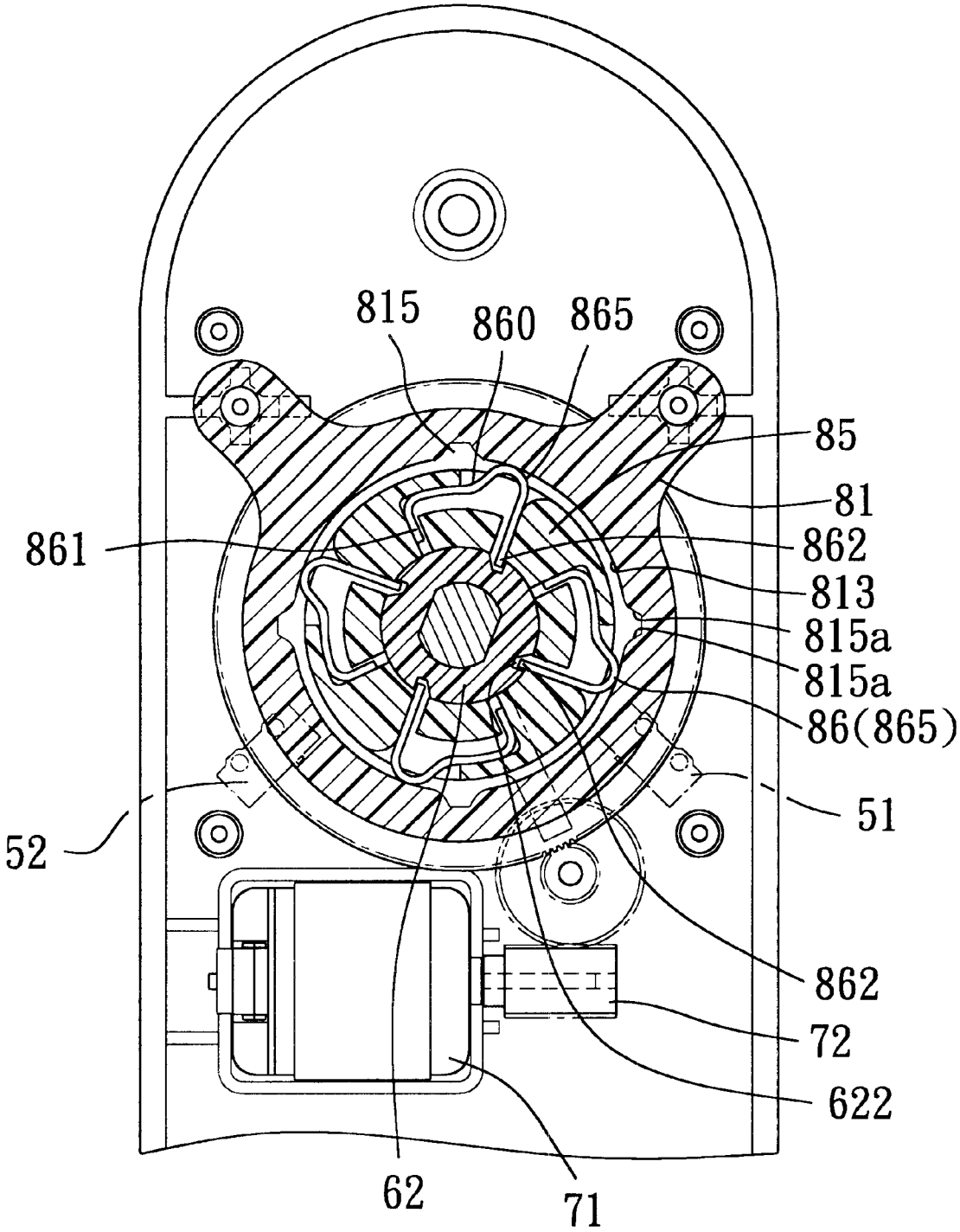
FIG. 8 is an elevational sectional view of the second preferred embodiment when the locking units are disposed in a second position.

Referring to FIGS. 6 to 8, the second preferred embodiment of the electric door lock 1' of the present invention is shown to have a structure similar to that of the previous embodiment, except for the construction of the locking units 86 and the shape of the mounting holes 851 in the clutch portion 85.

Each of the mounting holes 851 in the clutch portion 85 has a first hole portion 853 that extends radially through inner and outer surfaces of the clutch portion 85 and that has inner and outer hole ends 853*a,* 853*b* formed respectively at the inner and outer surfaces of the clutch portion 85, and a second hole portion 854 communicated with the first hole portion 853 and extending transversely from the first hole portion 853. Each of the locking units 86 includes a locking member 860 which is in the form of a resilient bent metal rod that has a first end 862 disposed at the inner hole end 853*a* of the first hole portion 853, a second end 861 opposite to the first end 862 and retained in the second hole portion 854, and a curved intermediate portion 865 between the first and second ends 862, 861 and disposed at the outer hole end 853*b* of the first hole portion 853. The intermediate portion 865 has a convex outer edge 865*a*.

The first end 862 of the metal rod serves as an inner locking portion of the locking unit 86. The curved intermediate portion 865 serves as an outer locking portion of the locking unit 86. Due to the resiliency of each of the metal rods, each of the locking units 86 is normally disposed in a first position shown in FIGS. 6 and 7, in which the outer locking portion 865 projects radially and outwardly from the outer surface of the clutch portion 85 and engages a respective one of the second locking grooves 815 in the stationary seat 81 for locking the clutch portion 85 to the stationary seat 81, and in which the inner locking portion 862 is retracted into the first hole portion 853 of the respective mounting hole 851 and disengages from a respective one of the first locking grooves 622 of the spindle coupling ring 62 for unlocking the clutch portion 85 from the spindle coupling ring 62, and thus from the spindle 61. At this time, the rotary knob 611 (see FIG. 2) is operable manually for rotating the spindle 61 so as to move the deadbolt 131 between the locking and unlocking positions.

When the electric driving motor 71 is operated to rotate the clutch portion 85, the convex outer edge 865*a* of the intermediate portion 865 of each of the locking members 860 slides past one of the tapered wall parts 815*a* and disengages from the respective one of the second locking grooves 815 for unlocking the clutch portion 85 from the stationary seat 81. The locking members 860 are then depressed by the inner peripheral surface 813 of the stationary seat 81 against their restoring action to enable the first end 862 of each of the locking members 860 to project from the inner surface of the clutch portion 85 and engage a corresponding one of the first locking grooves 622 in the spindle coupling ring 62 for locking the rotary seat 8 to the spindle coupling ring 62, thereby enabling co-rotation of the spindle 61 with the rotary seat 8' for moving the deadbolt 131 (see FIG. 1) between the locking and unlocking positions, and co-rotation of the switch actuator 63 with the spindle 61 for actuating one of the locking and unlocking switch members 52, 51.

It has thus been shown that, in the electric door lock of the present invention, the clutch portion 832, 85 is normally unlocked from the spindle coupling ring 62. As such, rotation of the spindle 61 is not hindered by any component of the electric door lock, thereby facilitating manual operation of the rotary knob 611.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electric door lock comprising:

a lock housing;

a deadbolt mounted in said lock housing and movable between locking and unlocking positions;

a manual operating member mounted on said lock housing and having a deadbolt operating spindle that extends into said lock housing and that is connected operably to said deadbolt, and a manually operable rotary knob that is secured to one end of said spindle and that is disposed externally of said lock housing;

a spindle coupling ring sleeved on said spindle so as to be co-rotatable therewith, said spindle coupling ring having an annular outer peripheral surface formed with a plurality of first locking grooves, each of said first locking grooves being displaced angularly from an adjacent one of said locking grooves by a predetermined angle with respect to an axis of said spindle;

a rotary seat having a circular gear plate portion that is sleeved rotatably on said spindle, said gear plate portion having a peripheral edge formed with a set of transmission teeth, said rotary seat further having an annular clutch portion connected fixedly and co-axially to said gear plate portion, said clutch portion being disposed around said spindle coupling ring, and having an inner surface confronting said spindle coupling ring, and outer surface opposite to said inner surface, said clutch portion being formed with a plurality of mounting holes aligned respectively with said first locking grooves in said spindle coupling ring, each of said mounting holes having an open inner hole end formed in said inner surface and an open outer hole end formed in said outer surface;

a stationary seat disposed within and secured to said lock housing, said stationary seat having a ring portion which is disposed around said clutch portion and which has an annular inner peripheral surface confronting said outer surface of said clutch portion, said inner peripheral surface being formed with a plurality of second locking grooves which are displaced angularly from one other by the predetermined angle with respect to the axis of said spindle;

a plurality of resilient locking units mounted respectively in said mounting holes in said clutch portion, each of said locking units having a locking member that has an inner locking portion disposed at said inner hole end of the respective one of said mounting holes, and an outer locking portion disposed at said outer hole end of the respective one of said mounting holes, said locking member being normally disposed in a first position, in which said outer locking portion of said locking member projects radially and outwardly relative to said outer surface of said clutch portion and engages a respective one of said second locking grooves in said stationary seat for locking said rotary seat to said stationary seat, and in which said inner locking portion of said locking member is retracted into said mounting hole and disengages from a respective one of said first locking grooves in said spindle coupling ring for unlocking said rotary seat from said spindle coupling ring, said rotary knob being operable to rotate said spindle for moving said deadbolt between said locking and unlocking positions when said locking members are disposed in the first position;

an electric driving motor having a transmission shaft coupled to said transmission teeth of said rotary seat, said electric driving motor being operable to drive rotation of said rotary seat for moving said locking units to a second position, in which said outer locking portion of said locking member of each of said locking units slides past the respective one of said second locking grooves and disengages from the respective one of said second locking grooves for unlocking said rotary seat from said stationary seat, and in which said locking member is depressed by said inner peripheral surface of said ring portion of said stationary seat against restoring action thereof so as to enable said inner locking portion of said locking member to project from said inner surface of said clutch portion and engage the respective one of said first locking grooves in said spindle coupling ring for locking said rotary seat to said spindle coupling member, thereby enabling co-rotation of said spindle for moving said deadbolt between said locking and unlocking positions;

an electric switch unit mounted in said lock housing and connected electrically to said electric driving motor; and a switch actuator mounted on said spindle for co-rotation therewith, said switch actuator projecting in a radial direction with respect to the axis of said spindle, said switch actuator being movable with said spindle relative to said electric switch unit and enabling said electric switch unit to control operation of said electric driving motor in a manner that said electric driving motor drives rotation of said spindle by the predetermined angle when said electric driving motor is operated.

2. The electric door lock as claimed in claim 1, wherein said electric switch unit includes a locking switch and an unlocking switch which are mounted in said lock housing and which are angularly displaced from each other with respect to the axis of said spindle, said switch actuator being disposed proximate to said locking switch when said spindle is rotated to move said deadbolt to the locking position, said switch actuator being disposed proximate to said unlocking switch when said spindle is rotated to move said deadbolt to the unlocking position.

3. The electric door lock as claimed in claim 1, wherein each of said second locking grooves of said stationary seat is defined by a groove-defining wall that has two tapered wall parts opposing each other, said outer locking portion of said locking member of each of said locking units sliding past one of said tapered wall parts of said groove-defining wall of a corresponding one of said second locking grooves when said rotary seat is rotated.

4. The electric door lock as claimed in claim 3, wherein said locking member of each of said locking units is in the form of a locking pin that has a head portion at said outer locking portion and having a convex outer surface which slides past said one of said tapered wall parts when said rotary seat is rotated, each of said locking units further having a compression spring disposed within a respective one of said mounting holes and sleeved around said locking pin for biasing said locking pin in a radial outward direction.

5. The electric door lock as claimed in claim 4, wherein each of said mounting holes includes a wider hole section adjacent to said outer hole end, a narrower hole section adjacent to said inner hole end, and a shoulder defined between said wider and narrower hole sections, said compression spring of each of said locking units being disposed in said wider hole section of the respective one of said mounting holes and between said shoulder and said head portion of said locking pin.

6. The electric door lock as claimed in claim 4, wherein each of said mounting holes extends in a radial direction through said clutch portion of said rotary seat.

7. The electric door lock as claimed in claim 3, wherein said locking member of each of said locking units is in the form of a resilient bent metal rod having a first end serving as said inner locking portion, a second end opposite to said first end and retained in the respective one of said mounting holes, and a curved intermediate portion between said first and second ends and serving as said outer locking portion, said intermediate portion having a convex outer edge that slides past said one of said tapered wall parts when said rotary seat is rotated.

* * * * *